United States Patent [19]

Phillips et al.

[11] 4,357,140

[45] Nov. 2, 1982

[54] ELECTRIC NEWSPAPER LOG ROLLER MACHINE

[76] Inventors: Curtis D. Phillips, Rte. One Box 125, Richland, Ind. 47634; Larry R. Davis, 3704 Longview Rd., Louisville, Ky. 40299; Kenneth E. Phillips, Rte. One, Newburg, Ind. 47630

[21] Appl. No.: 200,005

[22] Filed: Oct. 23, 1980

[51] Int. Cl.[3] ..... B31C 1/00

[52] U.S. Cl. ..... 493/307; 242/67.1 R; 493/304; 493/462

[58] Field of Search ..... 493/307, 304, 303, 462; 242/67.1 R, 67.3

[56] References Cited

U.S. PATENT DOCUMENTS

| | | | |
|---|---|---|---|
| 1,549,493 | 8/1925 | Lane | 493/304 |
| 3,958,499 | 5/1976 | Albee, Jr. | 493/307 |
| 3,964,373 | 6/1976 | Christen, Jr. et al. | 493/307 |
| 4,039,299 | 8/1977 | Porter et al. | 493/307 X |
| 4,068,564 | 1/1978 | Dahlstrom | 493/304 X |
| 4,165,678 | 8/1979 | Hart | 493/303 X |
| 4,192,226 | 3/1980 | Agostinelli | 493/307 X |

*Primary Examiner*—James F. Coan

*Attorney, Agent, or Firm*—Richard L. Caslin

[57] ABSTRACT

A portable, motor operated machine is shown having a box-like housing or work surface that supports an electric motor on one side thereof. A removable elongated shaft or spit is connected into a receiving socket of the motor so as to be turned thereby. The shaft extends transversely across the housing or work surface, and there is a quick-releasable shaft-bearing mounted on the opposite side of the housing for supporting the other end of the shaft. A sheet of newspaper is adapted to be attached to the shaft for winding the paper onto the shaft as the motor slowly turns the shaft. A first pressure plate is hingedly supported near the rear edge of the housing, and it is urged into engagement with the paper roll. A second pressure plate is hingedly supported from the rear edge of the housing and it carries the first pressure plate means thereon. An elongated guide roller is positioned adjacent the front of the machine below the shaft for applying tension to the paper. Both pressure plate means serve to increase the tension force on the paper being rolled so that the paper roll or log being formed is tightly wound, and, therefore, will be slow burning and longer lasting.

10 Claims, 5 Drawing Figures

10
12
12
14
16
16
22
24
26
28
30
32
34
36
38
40
50
52
54
56
58
62
64
68
70
70
70
72
72
74
76
92
96
104
106
108

ELECTRIC NEWSPAPER LOG ROLLER MACHINE

BACKGROUND OF THE INVENTION

1. Field of the Invention

This invention relates to a power operated machine for rolling used newspapers into a combustible fireplace log, and particularly an electric motor driven newspaper log rolling machine.

2. Description of the Prior Art

The high cost of home heating fuel, whether it be by gas, oil, coal, or electricity, has encouraged home owners to rely more upon their fireplaces for burning wood and other combustible material in the fireplace for maintaining a comfortable ambient temperature within the home. Fireplace logs are also increasing in price. Most people have difficulty disposing of their daily newspaper accumulations; hence, the interest in devising machines for helping roll the old newspapers into fireplace logs is becoming more inviting.

Newspaper log rolling machines have been used in the past. An early paper log rolling machine is described in the Butz U.S. Pat. No. 3,936,007. There is described a hand operated machine for winding sheet materials such as old newspapers into a roll to form a combustible fireplace log. This machine has a base on which there is mounted a spindle for rotation parallel to the base and movement vertically with respect thereto. Each end of the spindle is provided with an overhead coiled spring which tends to hold the spindle down, thus applying pressure against the paper roll so as to obtain a tight coil of paper for maximum long burn without pre-treatment of the sheet material.

The Albee U.S. Pat. No. 3,958,499 describes another primitive hand operated machine for rolling newspapers into fireplace logs. This invention relates more to the crank arm with its elongated shank portion for gripping the newspaper, rather than to the details of the machine itself.

The next patent relates to an invention which is available on the market, that is Christen et al U.S. Pat. No. 3,964,373. The machine includes an upwardly opening pan that is supported between the two end frames. An elongated shaft is supported above the pan, and leaf springs are mounted within the pan for applying upward directed force upon the newspapers being wound on the shaft for urging the newspapers into a tightly wound condition so that they will retain that formation and will be amenable to storage pending usage.

The Porter U.S. Pat. No. 4,039,299 is the first patent showing a motor driven spindle or shaft for forming rolls of newspaper logs. This machine includes a solution-containing reservoir above which is mounted a removable slotted shaft through which the end of the newspaper is placed. The motor drives the shaft causing the paper to be rolled thereon as it is passed through the solution in the reservoir. The newspaper is fed to the shaft along a tilting platform, which is supported upon a knife edge for rotational purposes. One edge of the platform is biased against the roll of paper to insure that it is correctly wound thereon into a paper fire log.

The Dahlstrom U.S. Pat. No. 4,068,564 describes another manually operated machine for rolling newspapers into burnable logs. One feature of this machine is that it comprises a plurality of rollers for bearing against the newspaper as the newspaper is being wound on the removable central winding roller so that it will be a compact or solid roll when it is completed. One advantage given for this design is that the machine is capable of being stopped at any stage of operation, and the rolling operation resumed later without loss of motion or material.

The last prior art patent is to Hart U.S. Pat. No. 4,165,678, which describes a second motor driven machine. The motor has a foot control so that the operator may have his hands free for feeding the newspaper. The invention appears to be mostly with the rectangular shaft or spindle that has two longitudinally tapered halves for clamping an edge of the newspaper that is to be wound thereon.

OBJECTS OF THE PRESENT INVENTION

The principal object of the present invention is to provide a motor operated paper log rolling machine having novel pressure plate means for increasing the tension on the paper during the rolling operation so that the resulting paper log will be tightly wound.

A further object of the present invention is to provide a motor driven paper log rolling machine of the class described with a first hinged pressure plate means biased into area engagement with the rolled paper and a second hinged pressure plate means supporting the first pressure plate means and for applying additional tension to the paper as it is being rolled.

A still further object of the present invention is to provide a motor operated paper log rolling machine of the class described wherein the said pressure plate means has strong area contact with the paper roll in the early stages of the rolling operation and lighter line contact with the paper roll in the later stages of the rolling operation so as to avoid tearing the paper.

SUMMARY OF THE INVENTION

The present invention provides a motor operated paper log rolling machine that includes a work surface that supports a motor adjacent one side thereof. A removable elongated shaft is connected into the motor at one end and is supported by a bearing at its other end to be positioned transversely of the work surface. Means are provided for attaching one edge of a wide sheet of paper to the transverse shaft for winding the paper onto the shaft as the motor drives the shaft. A hinged pressure plate means is biased into engagement with the rolled paper at a location above the shaft for creating a tension force on the paper being rolled. An elongated guide roller is positioned adjacent the front of the machine below the shaft for applying tension to the paper.

BRIEF DESCRIPTION OF THE DRAWINGS

This invention will be better understood from the following description taken in conjunction with the accompanying drawings and its scope will be pointed out in the appended claims.

DESCRIPTION OF THE PREFERRED EMBODIMENTS

Figure 1:
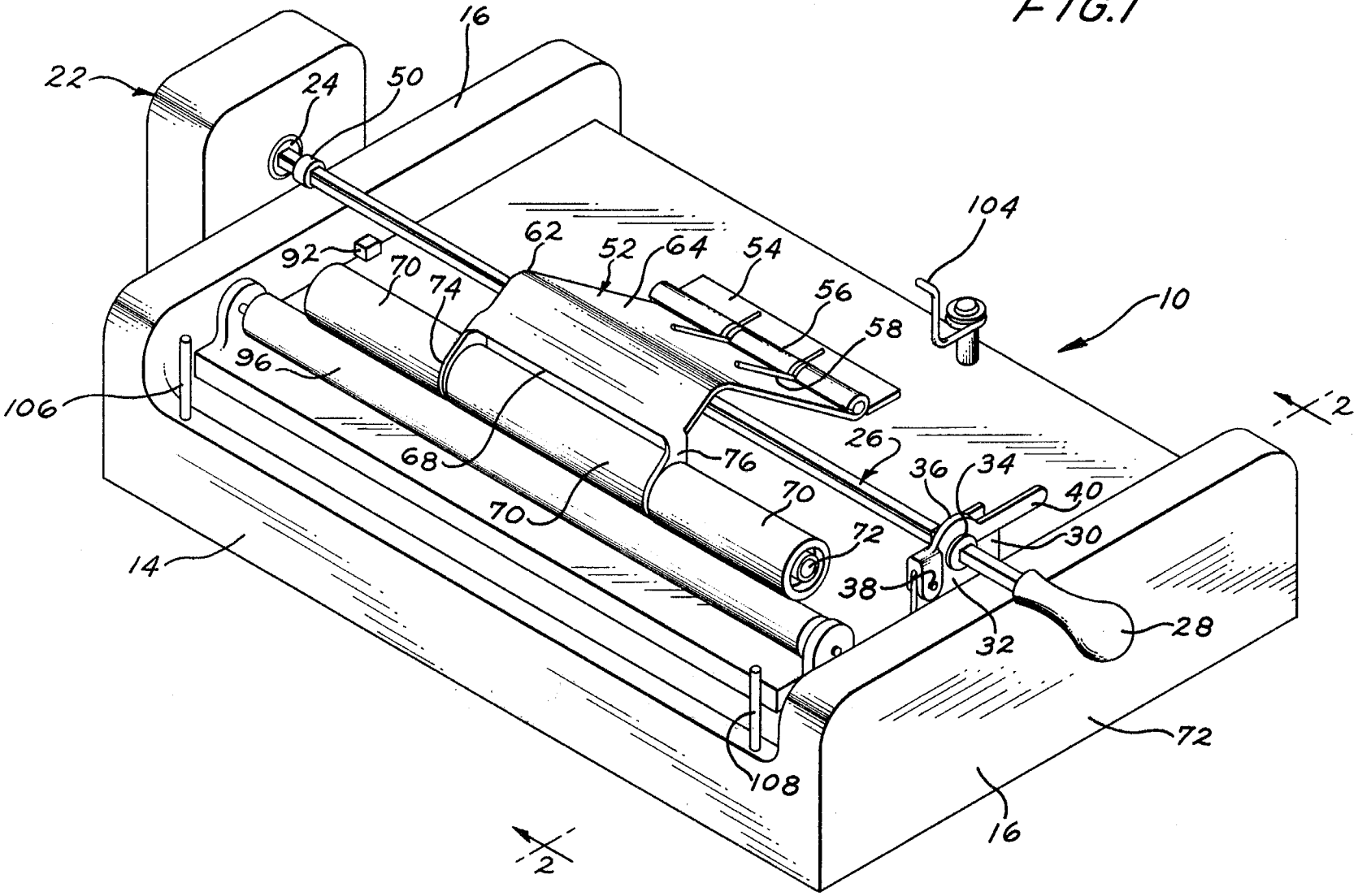
FIG. 1 is a top perspective view of a portable motor operated paper log rolling machine according to the present invention.
Figure 2:
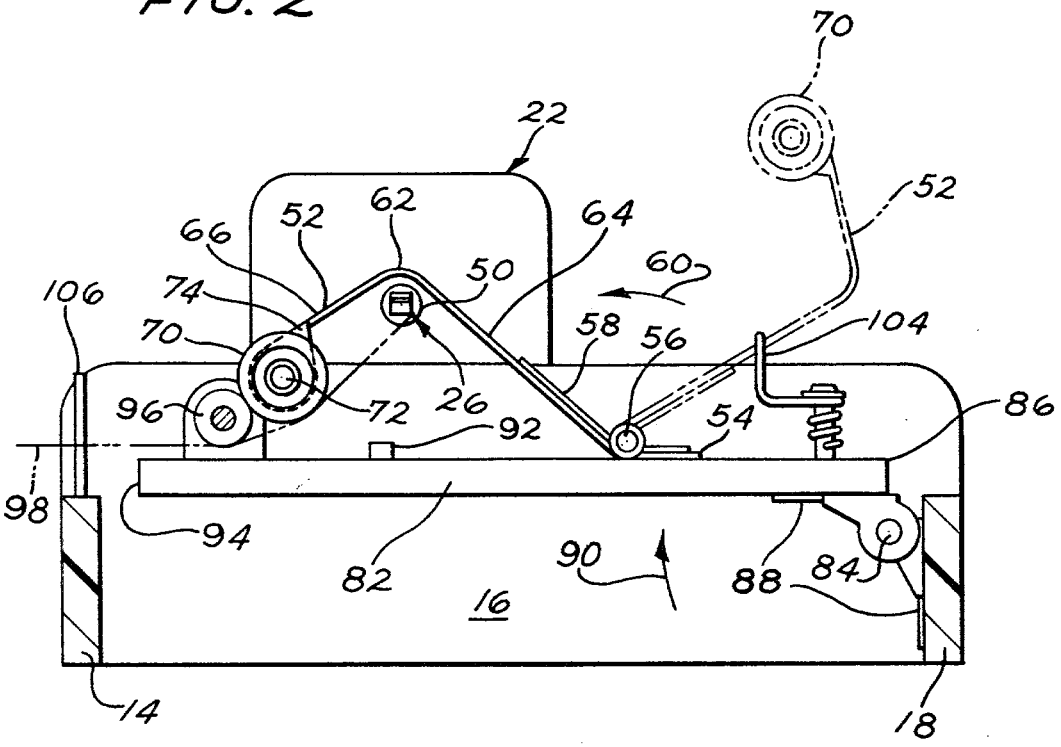
FIG. 2 is a right side cross-sectional elevational view taken on the line 2—2 of FIG. 1 and showing how the paper is threaded into the machine and connected to the elongated shaft, but before the motor is operated to start to wind the paper on the shaft.
Figure 3:
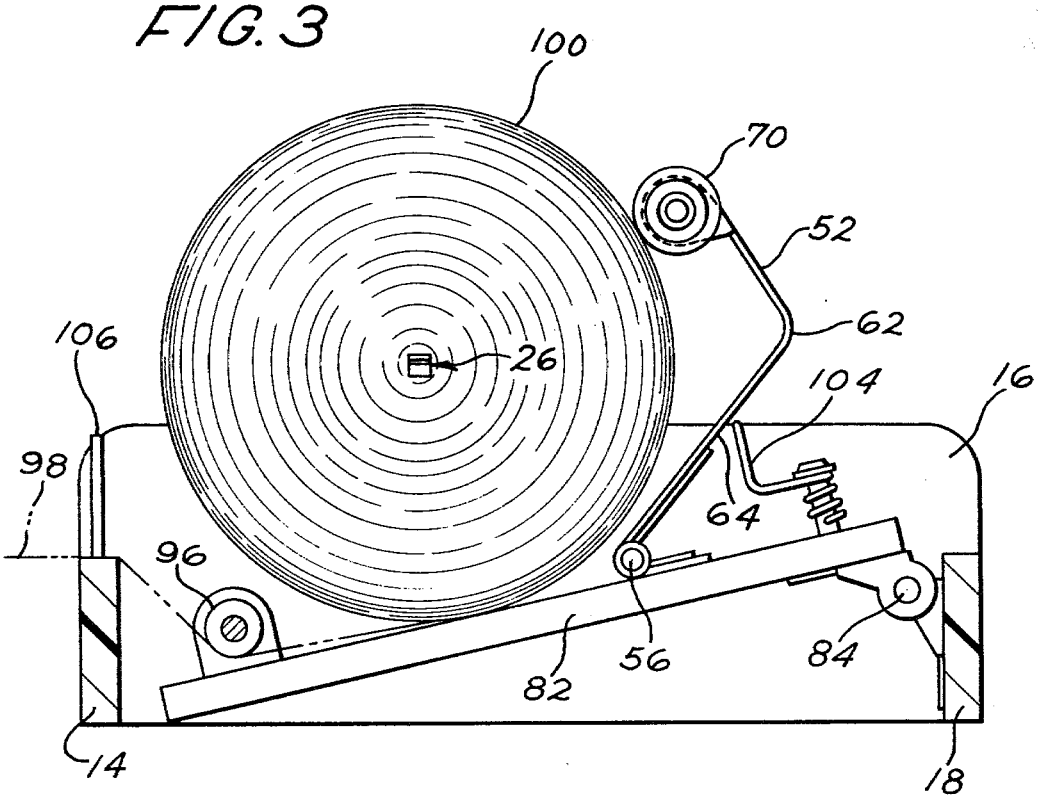
FIG. 3 is a right side cross-sectional elevational view, similar to that of FIG. 2, after the paper roll has been wound to about its maximum size and showing the first pressure plate means bearing on the roll at a location above the shaft, and the second pressure plate means, which supports the first pressure plate means, bearing against the paper roll near the underside thereof with a spring-biased force.

Turning now to a consideration of the drawings, and, in particular, to the top perspective view of FIG. 1, there is shown a motor operated paper log rolling machine 10 which has a box-like housing or work surface 12 of generally rectangular shape with a front wall 14, parallel side walls 16, and a rear wall 18, as is seen in FIG. 2. The housing or work surface 12 may or may not have a bottom wall. FIGS. 1–3 of the drawings show the elimination of the bottom wall such that the housing is open at the bottom, for the reason that except for reinforcing the housing, there is no need to support anything on a bottom wall of the housing. To give some idea of the size and shape of this box-like housing 12, it is about the size of a soft drink crate for supporting two dozen soft drink bottles or cans. Thus, it will be understood that this machine 10 is a portable machine that is easy to carry around and is light weight and may be stored easily in an out-of-the-way location. Notice that the front and rear walls 14 and 18 are of shortened height as compared with the height of the opposite side walls 16.

A principal feature of this invention is a combined electric motor and gear reduction unit 22, which is attached to the outer side of the left-hand side wall 16 of the housing. This motor and gear reduction unit 22 has a driven socket 24 for receiving the free end of an elongated shaft 26, which extends transversely across the housing or work surface 12, and has a handle 28 on its opposite end. A quick-releasable shaft-bearing member 30 is supported from the interior side of the right-hand side wall 16 for supporting the handle end of the shaft 26 in combination with the driven socket 24 that supports the free end of the shaft 26. This shaft-bearing member 30 has a vertical flat plate 32 with a vertical slot (not shown) in its upper edge for receiving the shaft 26 therein. The shaft is provided with a plastic bushing 34, which is adapted to rotate within the slot. Moreover, there is a pivoted latching member 36 that is hinged to the vertical plate 32 by pin 38. This latching member extends over the bushing 34, and it has a short handle 40 for raising the latching member out of engagement with the shaft 26 so that the shaft may be lifted out of the slot in the vertical plate 32. It should be understood that this combination of the motor and gear reduction unit 22 with the elongated shaft 26 and bearing member 30 is very much like the structure of a motor operated rotisserie for use with a charcoal grill. Thus, the speed of rotation of the shaft 26 is preferably about 10 revolutions per minute. It should be understood that the plastic bushing 34 has a flange like that of a railway wheel which cooperates with the inner surface of the vertical plate 32 so as to interlock between the bushing and plate and prevent the withdrawal of the shaft 26 from the socket 24 of the motor unit 22. Also, that the pivoted latching member 36 serves to hold the bushing 34 within the vertical slot of the plate 32.

Figure 4:
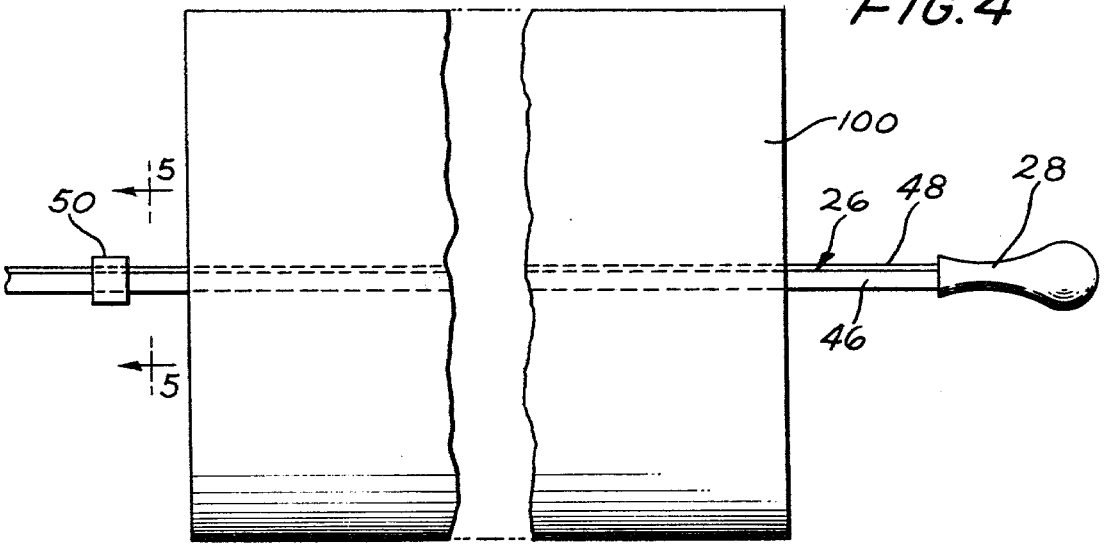
FIG. 4 is a fragmentary view showing the elongated shaft as having a split construction for clamping the edge of the paper sheet therebetween and being held together by a sleeve at one end and a handle for the shaft at the opposite end.
Figure 5:
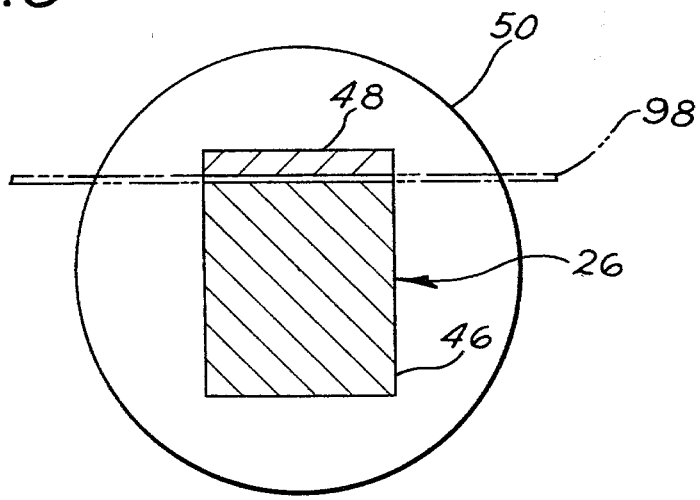
FIG. 5 is a fragmentary cross-sectional view of the shaft taken on the line 5—5 of FIG. 4, but on a much enlarged scale, to show the nature of the sleeve for clamping the two-part shaft together for releasably holding the starting edge of the paper therebetween.

As is best seen in FIGS. 4 and 5, the elongated transverse shaft 26 is of two part construction, having a first rod 46 that is generally square in transverse cross section and a second flat strip 48 which is about the same width as the rod 46 and overlies one side thereof, as is clear from FIG. 5. This flat strip 48 is held to the first rod 46 by means of the handle 28 at one end, and by means of a removable sleeve 50 adjacent the other end. Thus, it should be understood that in order to thread a sheet of newspaper to the shaft 26, the operator would sit down in front of the machine 10 and loosely position the shaft 26 in the general position as shown in FIG. 1. Then the operator would remove the sleeve 50 from the left end of the shaft, and, of course, this can only be done if the shaft is separated from the socket 24 of the motor unit 22. With this sleeve 50 removed, it is possible to raise the flat strip 48 at one end while the other end is still held within the handle 28. Then the leading edge of the newspaper can be slipped between the flat strip 48 and the rod 46 for almost the complete length of the shaft 26, and when this stage is completed, then the sleeve 50 is reinstalled and the shaft 26 is positioned within the socket 24 of the motor unit and the bushing 34 is lowered into the vertical slot of the vertical plate 32, and the pivoted latching member 36 is turned down over the bushing to the locking position, as shown in FIG. 1.

As mentioned above, it is considered important to roll the newspaper tightly on the shaft 26 so that the paper log that will result will be of high density because it is tightly wound, and, thus, it will be slow-burning and long-lasting as a source of fuel. Attention is now directed to the right side cross-sectional elevational view of FIG. 2. Associated with the elongated transverse shaft 26 is a first hinged pressure plate 52, which in the start position of the machine 10 is adapted to overlie the shaft, as is seen in both FIGS. 1 and 2. This pressure plate 52 has a support end 54 in combination with a hinge means 56, as well as a heavy torsion spring 58 for normally urging the pressure plate in a counterclockwise direction, as seen in FIG. 2, and indicated by the directional arrow 60. The first pressure plate 52 is of arched construction, as best seen in the right-side view of FIG. 2. This arched plate 52 has a wide-angle bend 62 near its midportion, that generally overlies the shaft 26. Thus, the wide-angle bend 62 divides the pressure plate 52 into an upwardly-inclined rear portion 64 and a downwardly-inclined front portion 66. The front edge 68 of the pressure plate means 52 is designed to support a transverse roller means 70. The front edge 68 is provided with side tabs 74 and 76, which are bent downward to be generally parallel to each other. Each tab 74 and 76 is formed with a central hole (not shown) for receiving an elongated shaft 72 therethrough. The roller means 70 is shown as being divided into three sections, one section being sandwiched between the two side tabs 74 and 76, and the other two sections being positioned outside the side tabs, so that all three roller sections are supported on the same shaft 72.

The main purpose of the arched configuration of the first hinged pressure plate 52 is so that during the early stages of the winding operation of the paper on the shaft 26 there will be a wide area contact between the upwardly-inclined rear portion 64 of the pressure plate, as best seen in FIG. 2, so as to create a strong tension force on the paper being rolled to insure that the paper is tightly wound. Later, as multiple layers of the paper are rolled onto the shaft 26, it is important to reduce the frictional contact between the first pressure plate 52 and the paper roll. This is accomplished by means of the roller means 70 at the front edge of the pressure plate 52 which engages the roll of paper and thereby lifts the rear portion 64 of the pressure plate out of contact with the paper roll, as is seen in FIG. 3. This rolling engagement between the roller means 70 and the paper roll substantially reduces the frictional contact between the pressure plate and the paper roll so as to avoid tearing the paper; especially, if there's already a tear in the paper so as not to magnify the tear and cause the paper to separate.

There is also a second hinged pressure plate 82 which is generally horizontally disposed and almost fills the area of the box-like housing 12, as is clear from FIGS. 1 and 2. A hinged support means 84 is supported from the interior surface of the rear wall 18, as well as being joined to the underside of the rear edge 86 of the pressure plate 82, as is best seen in FIGS. 2 and 3. A torsion spring means 88 is associated with the hinge support means 84 to normally urge the second pressure plate 82 in an upward clockwise direction, as indicated by the directional arrow 90. A stop means 92 is formed on the interior surface of one of the side walls 16 to limit the upward movement of the second pressure plate 82 to its horizontal position, as shown in FIG. 2. The front edge 94 of the second pressure plate 82 is furnished with an elongated guide roller 96 so that a sheet of paper 98 is first threaded under this guide roller 96 and then up to the elongated shaft 26 where it is fastened, as explained earlier. Once the paper 98 is threaded onto the shaft 26 and the motor 22 is energized, the paper will be drawn around the shaft 26 and the paper roll will build up in size, all the while bearing against the underside of the upwardly-inclined rear portion 64 of the first hinge pressure plate 52. As the paper roll becomes larger and larger in circumference, the roller means 70 will eventually engage the periphery of the paper roll and lift the midportion of the pressure plate 52 away from engaging the paper, as for example as shown in FIG. 3.

It is well to notice that the first pressure plate 52 is hingedly supported to the second pressure plate 82 by means of the support end 54 being fastened by screw fasteners or the like to the top surface of the second pressure plate. Thus, the first and second pressure plates 52 and 82 respectively cooperate with each other, especially in the final stages of the winding operation, as is best seen in FIG. 3. As the paper roll becomes larger and larger, it will engage the top surface of the second pressure plate 82 and force this second pressure plate downward in a counterclockwise direction, such that the second pressure plate contributes a frictional tension force on the paper to insure that the paper roll is tightly wound on the shaft 26. Notice when the second pressure plate 82 touches the bottom of the box-like housing 12 or the support means for the box-like housing 12, the second pressure plate can move no further and thus the paper roll will finally come to a halt due to the frictional resistance between the paper roll and the second pressure plate. Thus, as a general rule, all of the paper logs will be substantially the same size in length and diameter.

It is an easy matter to separate the paper log 100 of FIG. 3 from the shaft 26 by first releasing the pivoted latching member 36, as shown in FIG. 1, from engagement with the shaft 26 so that the handle end of the shaft may be raised out from engagement with the slot in the vertical plate 30. Then the other end of the shaft may be disengaged from the socket 24 of the motor unit 22. Then while supporting the shaft and paper log 100 with the right hand grasping the handle 28, the left hand will slide the removable sleeve 50 off of the shaft so that the flat strip 48 can be loosened from the first rod 46 of the shaft and then by pulling the shaft by its handle from within the center of the paper log 100, the log can be removed from the shaft. While this operation is taking place, it is frequently desirable to incapacitate the first pressure plate 52, and this may be done as shown in dotted lines in FIG. 2 by pushing the first pressure plate rearwardly out of the way of the paper log until it can be engaged by a releasable hook member 104, which is shown mounted on the second pressure plate 82 near the rear edge 86 thereof.

As best seen in FIG. 1, a pair of vertical guide pins 106 and 108 are shown mounted at the opposite ends of the front wall 14 of the housing or work surface 12 to serve as a guide for the paper sheet being fed under the guide roller 96 and onto the shaft 26.

Having described above a novel portable motor-operated paper log rolling machine, it will be readily apparent to those skilled in this art that we have devised a machine that is light in weight yet stable in operation, in that it has a wide base that cannot be easily overturned. Thus, one person can operate this machine when the machine is on a table or desk or workbench, in that the machine is stable in and of itself, while the operator uses both hands to feed the paper between the guide pins 106 and 108 under the guide roller 96 and onto the shaft 26. The paper roll 100 would be tied or rubberbands would be placed around it before the roll is withdrawn from the shaft 26. Then the roll wound be placed in water so that it becomes soaked and then stored to be dried out before use. Another good operating station for such a machine would be on a chair in front of an operator who sits on a similar chair positioned in front of the first chair.

Modifications of this invention will occur to those skilled in this art. Therefore, it is to be understood that this invention is not limited to the particular embodiments disclosed, but that it is intended to cover all modifications which are within the true spirit and scope of this invention as claimed.

What is claimed is:

1. An apparatus for forming paper logs from sheets of paper comprising:

a. a work surface;

b. motor means stationarily mounted with respect to the work surface;

c. a removable elongated shaft connected at one end to and turned by said motor means, said shaft means extending transversely across said work surface, a quick-releasable shaft-bearing member mounted on the work surface at a location remote from said motor means for supporting the other end of the shaft therein;

d. and means for attaching one edge of a wide sheet of paper to the said shaft for winding the paper onto the shaft as the motor drives the shaft;

e. a hinged pressure plate means biased into engagement with the rolled paper at a location above the shaft for creating a tension force on the paper being rolled;

f. and an elongated guide roller positioned adjacent the front of the work surface and below the shaft, whereby the paper is fed under the said guide roller and then upwardly to be attached to the said winding shaft, and the guide roller serves to apply a tension force on the paper when a braking force is applied to the paper by the operator of this apparatus as the paper is wound onto the shaft.

2. The invention as recited in claim 1 wherein the said pressure plate means is first biased into area engagement with the rolled paper for creating the tension force on the paper being rolled, and roller means positioned adjacent a free edge of the pressure plate means to create a second low friction engagement with the paper after the paper roll becomes of multiple thicknesses.

3. The invention as recited in claim 1 wherein the said pressure plate means has a hinged support means adjacent the rear of the work surface, and an elongated roller means supported transversely adjacent a front edge of the pressure plate means for engaging the paper roll, and torsion spring means associated with the hinged support means for urging the pressure plate means into engagement with the paper.

4. The invention as recited in claim 3 wherein there is a second pressure plate means that is hingedly supported from the said work surface, and spring means for urging this second plate means upwardly, said second plate means serving as the support means for the hinged support means of the said first pressure plate means, said second pressure plate means also serving to support the said elongated guide roller adjacent a front edge thereof for guiding the paper sheet onto the said shaft, the mid-portion of the said second pressure plate means engaging the paper roll in the late stages of the rolling operation to increase the tension force on the paper being rolled.

5. The invention as recited in claim 2 wherein the said first pressure plate means is of arched configuration in side view that is adapted to overlie the said shaft so as to have area contact with the paper roll in the early stages of winding the paper onto the shaft, and the said roller means serving to engage the paper roll with a much reduced area of contact in the later stages of winding the paper onto the shaft.

6. The invention as recited in claim 4 wherein the said work surface includes stop means for engaging the second pressure plate means to limit the upward movement of such plate means, and the rear portion of the second pressure plate means includes a latching means for engaging the first pressure plate means in a retracted position remote from the shaft for use in unloading the shaft and its paper roll from the apparatus.

7. A motor-operated paper log rolling machine comprising:

a. a wide box-like housing having at least two generally parallel side walls and front and rear walls joining the side walls into a stable supporting structure;

b. a combined electric motor and gear reduction unit mounted on one side wall;

c. a quick-releasable shaft-bearing member mounted on the opposite side wall, and a removable elongated shaft mounted transversely of the housing from the said motor unit at one end and from the bearing member at its other end; whereby the motor unit is capable of driving the shaft at a slow rate of speed for winding multiple sheets of paper thereon;

d. said elongated shaft member being of two part construction with a first heavy rod portion and a second flat strip portion which extends for generally the length of the rod portion, the rod and strip serving to clamp the paper therebetween, the rod and strip being joined together at one end of the shaft by a handle portion and at the other end of the shaft adjacent the said motor unit by a removable sleeve.

8. The invention as recited in claim 7 wherein a hinged pressure plate means is biased into engagement with the roll of paper on the shaft at a location above the shaft for creating a tension force on the paper being rolled.

9. The invention as recited in claim 8 wherein a second hinged pressure plate means is biased into engagement with the roll of paper on the shaft at a location below the shaft during the later stages of the winding operation for increasing the tension force on the paper being rolled.

10. The invention as recited in claim 9 wherein the said second hinged pressure plate means is supported from the rear wall of the housing, while the said first hinged pressure plate means is supported from the said second hinged pressure plate means.

* * * * *